US005988185A

United States Patent [19]

Gueret

[11] Patent Number: 5,988,185

[45] Date of Patent: Nov. 23, 1999

[54] COMPACT WITH PROTECTIVE ELEMENT ELASTICALLY PRESSED AGAINST PRODUCT

[75] Inventor: Jean-Louis H. Gueret, Paris, France

[73] Assignee: L'Oreal, Paris, France

[21] Appl. No.: 08/953,320

[22] Filed: Oct. 17, 1997

[30] Foreign Application Priority Data

Oct. 17, 1996 [FR] France ..... 96 12663

[51] Int. Cl.[6] ..... A45D 33/00

[52] U.S. Cl. ..... 132/294; 132/301

[58] Field of Search ..... 132/306, 307, 132/300, 293, 294, 303

[56] References Cited

U.S. PATENT DOCUMENTS

| | | | |
|---|---|---|---|
| 1,194,187 | 8/1916 | Kendall | 132/303 |
| 1,813,281 | 7/1931 | Davis . | |
| 2,054,004 | 9/1936 | Sandberg . | |
| 2,438,841 | 3/1948 | Casalino | 132/300 |
| 2,656,090 | 10/1953 | Hamblet | 132/293 |
| 4,129,213 | 12/1978 | Fleig . | |
| 5,520,202 | 5/1996 | Arbree | 132/293 |
| 5,533,823 | 7/1996 | Pierpoint et al. . | |
| 5,603,340 | 2/1997 | Gueret | 132/306 |

FOREIGN PATENT DOCUMENTS

| | | | |
|---|---|---|---|
| 562965 | 9/1993 | European Pat. Off. | 132/293 |
| 737089 | 5/1932 | France . | |
| 2539968 | 8/1984 | France | 132/293 |
| 2 683 669 | 5/1993 | France . | |
| 295 04 252 U1 | 8/1995 | Germany . | |
| 07184717 | 7/1995 | Japan . | |
| 08126522 | 5/1996 | Japan . | |
| WO 95/29607 | 11/1995 | WIPO . | |

*Primary Examiner*—Todd E. Manahan
*Attorney, Agent, or Firm*—Oblon, Spivak, McClelland, Maier & Neustadt, P.C.

[57] ABSTRACT

A packaging device, in particular for a make-up product, having a body defining a recess for the packaged product, and a lid capable of covering the body in a detachable manner, the product having a free surface for taking up the product. The compact has at least one resiliently deformable element mounted in such a way that, when the lid is in its closed position on the body, the free surface bears elastically against a protective element covering substantially the whole of the free surface. The protective element being impermeable to at least one solvent present in the product.

18 Claims, 4 Drawing Sheets

COMPACT WITH PROTECTIVE ELEMENT ELASTICALLY PRESSED AGAINST PRODUCT

BACKGROUND OF THE INVENTION

1. Field of the Invention

The present invention relates to a packaging device, in particular for a make-up product. The invention is particularly suitable for powdery or pasty products or products in the form of a gel. By way of example, the packaging unit in accordance with the invention may be used for a blusher, a make-up foundation, a cheek make-up and etc.

2. Discussion of the Background

The make-up products which are intended to be frequently used are generally packaged in compacts or pots of small dimensions, provided with lids having simple locking mechanisms which are convenient to use.

To prevent these make-up products from deteriorating on contact with the ambient air, it is necessary for these compacts or these pots to have a good, airtight seal.

However, this seal is not always sufficient, in particular because of the wear sustained by the locking mechanism of the lid which is frequently used.

FR-A-2 412 474 describes a container or compact in which the compartment, wherein the product is placed, is obturated in a leakproof manner by means of a bellows that adheres tightly to a wall surrounding the compartment. The bellows may be joined in its central portion to the internal side of the lid, and in the closed position of the lid it can come to be applied to a flat bearing means round the compartment. Means are provided for suppressing the bellows effect during the opening. During the closing of the compact, air is enclosed between the free surface of the product and the bellows. This space, which permits a release of the solvent, will become increasingly large as the level of the product diminishes in the container.

In other known systems the seal is ensured by means of a lip arranged in the lid. The lip capable of cooperating in a leakproof manner with a groove in the bottom of the compact, all round the compartment.

In the case of all these systems, the preservation of the product is precarious during use, because an air pocket situated above the product will be created during use, which will allow the product to release its solvent (or solvents) in a quantity which depends on the space situated between the lid and the product. During each opening, a considerable quantity of the solvent will thus escape and will, in the course of time, limit the preservation and quality of the product. Since the space becomes increasingly large in the course of use, the loss of solvent thus becomes increasingly important. Typically, the solvent may be water (up to approximately 20%), isoparaffin, silicone and etc. The product may include a mixture of several solvents.

SUMMARY OF THE INVENTION

Thus, an object of the present invention is to provide a packaging device for a powdery or pasty product, or a product in the form of a gel, wherein the degree of evaporation of the solvent (or solvents) forming part of its composition is substantially reduced, as compared with the systems discussed above.

Another object of the invention is to ensure a substantially good seal throughout the whole life span of the product.

Other objects of the present invention will emerge in detail in the description that follows.

In accordance with the invention these objects are attained by means of a packaging device, in particular for a make-up product, comprising: a body having a cavity opening out in its upper portion and forming a recess for the packaged product; and a lid capable of covering the body in a detachable manner, the product having a free surface accessible for taking up the product; wherein it includes at least one resiliently deformable element mounted in such a way that, in the closed position of the lid on the body, the free surface bears elastically on a protective element covering substantially the whole of the free surface, the protective element being impermeable to at least one solvent present in the product. The protective element may for example be formed by a film of polyethylene, polypropylene, or a complex of polyethylene terephthalate/aluminum/polyethylene, and etc.

The protective element may be in contact with the free surface of the product through a screen, axially fixed, the bottom of the cavity having a piston holding the free surface of the product in contact with the screen, a flexible element exerting a pressure on the piston so as to allow the distribution of the product through the screen. The screen may be comprised of a woven or non-woven material, a grill, a foam, a film or a perforated surface, or a combination of these elements. During the take-up of the product, the screen remains substantially immovable relative to the rigid body.

Advantageously, the protective element is formed by an element which is mounted on the lid by means of a spring mechanism. The spring mechanism may be formed by a helical spring.

According to an alternative embodiment, the protective element is mounted on a block of resilient foam joined to the lid.

The protective element may take the form of a closed cell foam, whose thickness and resilience are chosen in such a way that the foam bears on the free surface of the product, irrespective of the level of fill of the product in the cavity. By way of an indication, this foam may be a polyethylene foam, foamed synthetic butadiene rubber (SBR), or a foam of polyvinyl chloride (PVC).

Advantageously, an element (for example an elastomer or a felt) impregnated with at least one solvent forming part of the composition of the packaged product is disposed between the protective element and the lid so as to keep the product in an atmosphere charged with the solvent.

According to another alternative embodiment, the product rests on a resiliently deformable element mounted in the bottom of the cavity, the free surface of the product bearing elastically against the protective element in the closed position of the lid on the body.

Preferably, the device takes the form of a compact whose lid is mounted in an articulated manner on the body round a hinge pin, closing means being disposed on the side remote from the hinge pin to lock the lid in its closed position on the body.

Moreover, the device may comprise means capable of ensuring a seal at the periphery of the cavity. Advantageously, such means include a skirt or a lip formed on the internal side of the lid, and capable of cooperating with a corresponding groove arranged all round the cavity in the body.

The resiliently deformable element, the protective element, and the sealing means at the periphery of the cavity may all be formed of a single piece, which contributes substantially to reducing the manufacturing costs of the compact.

The packaged product may be, by way of example, a blusher, a make-up foundation, a cheek make-up and etc.

BRIEF DESCRIPTION OF THE DRAWINGS

To render the object of the invention more readily understood, some preferred embodiments, given by way of example and without any restrictive nature, will now be described with reference to the attached drawings, wherein.

DETAILED DESCRIPTION OF THE PREFERRED EMBODIMENTS

Figure 1A:
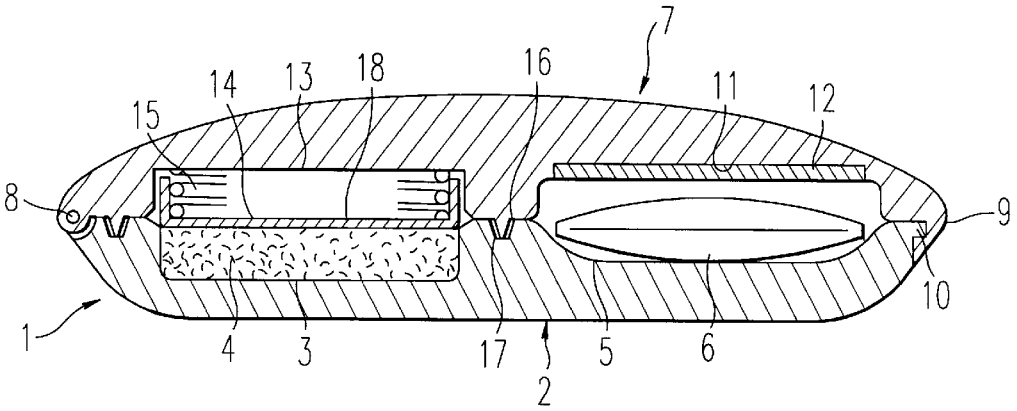
FIGS. 1A–1C illustrate a first embodiment of a packaging device in accordance with the invention.
Figure 1B:
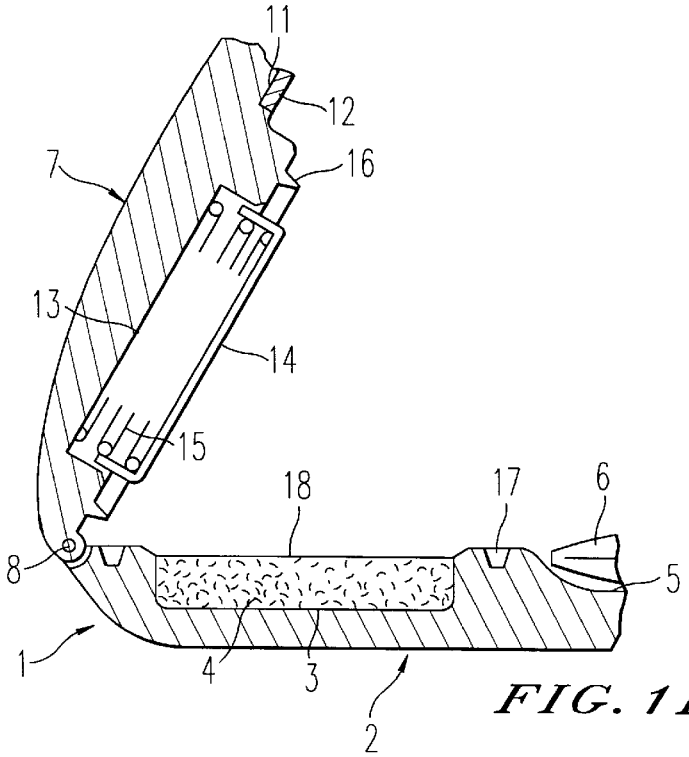
Figure 1C:
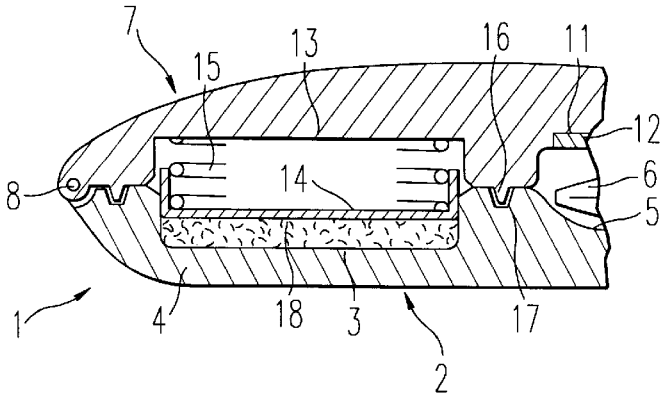

Referring now to the drawings, wherein like reference numerals designate identical or corresponding parts throughout the several views, and more particularly to FIGS. 1A–1C thereof, the packaging device 1 takes the form of a case of the type of a make-up compact, comprising a body or bottom part 2 defining a first hollow compartment or cavity or first recess 3 for receiving the product 4 in a powdery or pasty form, or in the form of a gel. The body or bottom part 2 defines a second recess 5 wherein an applicator 6 is disposed, such as foam puff. A lid 7 is articulated on the body or bottom part 2 round a hinge pin 8. The lid 7 has a clasp 9 capable of cooperating with a complementary locking element 10 carried by the bottom part 2 of the compact 1, so as to lock the lid 7 on the bottom part 2 in its closed position. The lid 7 has a first recess 11 situated substantially opposite the second recess 5 of the bottom part 2, and in the bottom of the first recess 11 of the lid 7 there is mounted (for example by bonding) a mirror 12. The lid 7 has a second recess 13 which, in the closed position of the lid 7 on the bottom part 2, is opposite the first recess 3 of the bottom part 2 wherein the product 4 is disposed. A protective element 14 is mounted inside the second recess 13 of the lid 7 by means of a resiliently deformable element or resilient element or spring mechanism 15, such as a helical spring. The spring 15 may be mounted in the bottom of the second recess 13 of the lid 7, for example by bonding or catch engagement. The protective element 14 is mounted on the free end of the spring 15, for example by bonding. Alternatively, the spring 15 and the protective element 14 may form a single piece obtained by molding. The protective element 14 takes the form of a generally planar element, such as a sheet of a material impervious to the solvent (or solvents) present in the formula of the product 4.

The protective element 14 is dimensioned in such a way as to substantially cover the whole of the free surface 18 of the product 4. By way of example, a sheet of polyethylene (PE), polypropylene (PP) or of a complex of polyethylene terephthalate/aluminum/polyethylene will be used. Around the second recess 13 of the lid 7, the lid 7 has a lip or skirt 16 capable of being inserted in a leakproof manner in a groove 17 arranged in the body or bottom part 2 of the compact 1 all round the cavity or first recess 3 of the bottom part 2 in the closed position of the lid 7 on the bottom part 2. These means make it possible to reinforce the seal of the packaging of the product 4.

Thus, in the closed position illustrated in FIG. 1A, the spring 15 keeps the sealing film or protective element 14 elastically bearing on the product 4. The sealing film or protective element 14 substantially covers the whole of the free surface 18 of the product 4 and considerably slows down its evaporation.

In the open position shown in FIG. 1B, the spring 15 is in its rest position. The product may be taken up by means of the applicator or puff 6.

In the closed position illustrated in FIG. 1C, the level of the product 4 in the compartment or first recess 3 of the bottom part 2 has subsided in the course of use. The sealing film or protective element 14 still bears elastically on the free surface 18 of the product 4. The length and elasticity of the spring 15 are, in fact, chosen so that, irrespective of the level of fill of the product 4 in the compact 1, the sealing film or protective element 14 always bears on the free surface 18 of the product 4. Thus, by means of this arrangement, substantially no air pocket exists between the product 4 and the lid 7 when the lid 7 is in its closed position on the bottom part 2, and this remains so throughout the whole life span of the product 4. The solvent therefore cannot escape from the product 4. The preservation and the quality of the product 4 are perfect during the life span of the product 4.

Figure 2:
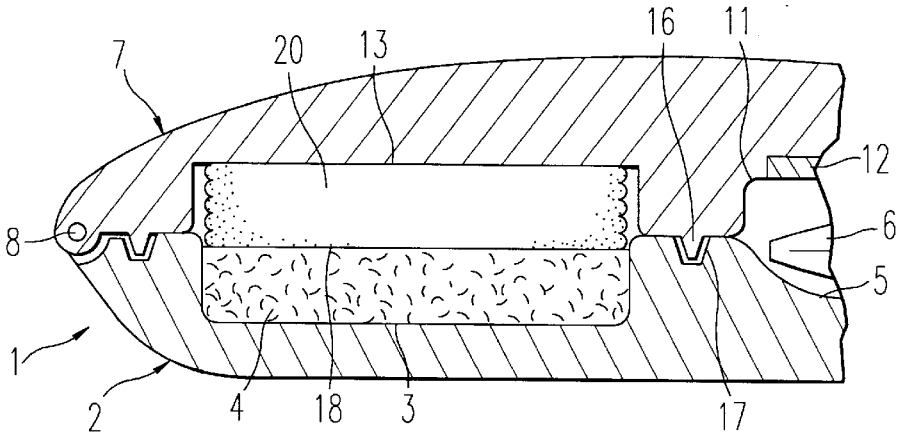
FIG. 2 illustrates a second embodiment of the packaging device in accordance with the invention.

In the embodiment of FIG. 2, the resiliently deformable element or spring 15 and the protective element 14 are replaced by a resiliently deformable block 20 of a resiliently deformable material and is also known as a resilient protective element. Its function is to keep a surface, which is impervious to the solvent (or solvents) forming part of the composition of the product 4, in bearing contact on the free surface 18 of the product 4 in the closed position of the lid 7 on the body or bottom part 2. For this purpose, a resiliently deformable block 20 of closed cell foam will be used which is impermeable to the solvent forming part of the composition of the packaged product 4. The thickness and resilience of the foam of the resiliently deformable block 20 are chosen so that the foam is in elastic bearing contact on the free surface 18 of the product 4, during substantially the whole life span of the product 4. The foam of the resiliently deformable block 20 may be bonded to the lid 7. By way of example, it is possible to use a closed cell foam such as a polyethylene foam, foamed synthetic butadiene rubber (SBR), or foamed polyvinyl chloride (PVC). Yet, other materials may be used. Thus, in the course of use, the foam of the resiliently deformable block 20 extends over a height substantially equal to the height of the product 4 taken-up, so as to remain in elastic bearing contact on the free surface 18. In the same way, as in the embodiment of FIGS. 1A–1C, the seal is reinforced by means of a lip 16/groove 17 arrangement situated all round the product 4.

Figure 3:
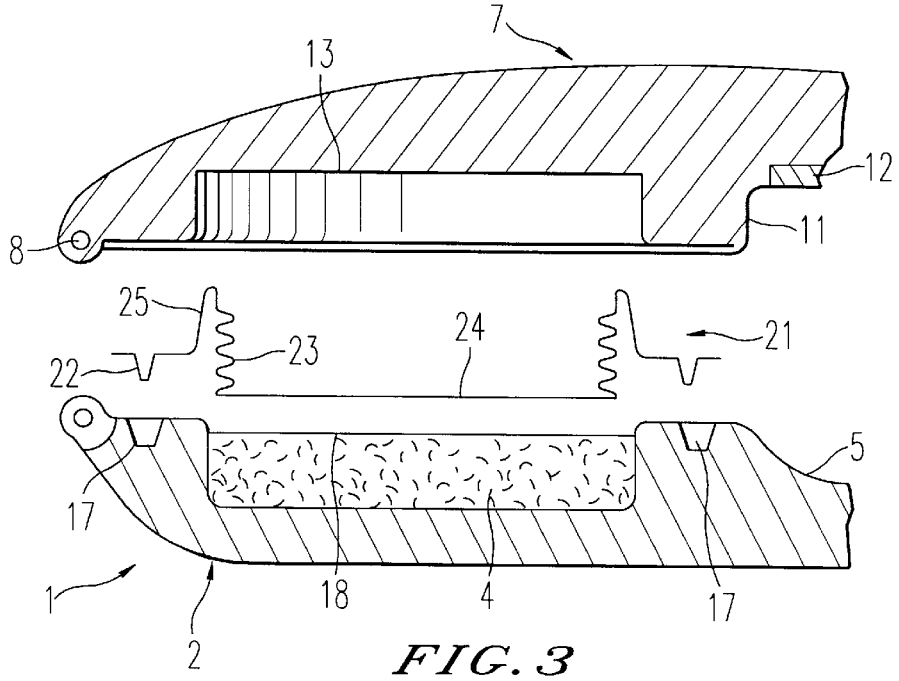
FIG. 3 illustrates a third embodiment of the packaging device in accordance with the invention.

In the embodiment of FIG. 3, a lip-seal element 21 having several functions is made in the form of a single piece (obtained for example by the molding of polyethylene or polypropylene). At its circumference, the lip-seal element 21 defines an annular part forming a projection 22, capable of cooperating in a leakproof manner with the groove 17 provided in the body or bottom part 2 of the compact 1. The lip-seal element 21 has, moreover, an intermediate annular part 23 forming an elastic bellows, whose free end is connected to a planar portion 24, capable of covering the whole free surface 18 of the product 4 in a substantially leakproof manner. The length and elasticity of the bellows of the intermediate annular part 23 are chosen in such a way that in the closed position of the lid 7 on the bottom part 2, the planar portion 24 bears elastically on the free surface 18 of the product 4. The bellows 23 is separated from the projection 22 by a side 25 orientated in the opposite direction to the projection 22, and whose external diameter is slightly larger than the internal diameter of the second recess 13 so as to be inserted with force into the second recess 13 of the lid 7. Alternatively, the lip-seal element 21 may be mounted in the second recess 13 of the lid 7 by bonding, by catch engagement or by welding. This arrangement is particularly advantageous in that it makes it possible to substantially reduce the cost of manufacture of the device in accordance with the present invention. Moreover, there is no break in the sealing function between the protective element on the product 4 and the seal at the periphery of the compact 1.

Figure 4A:
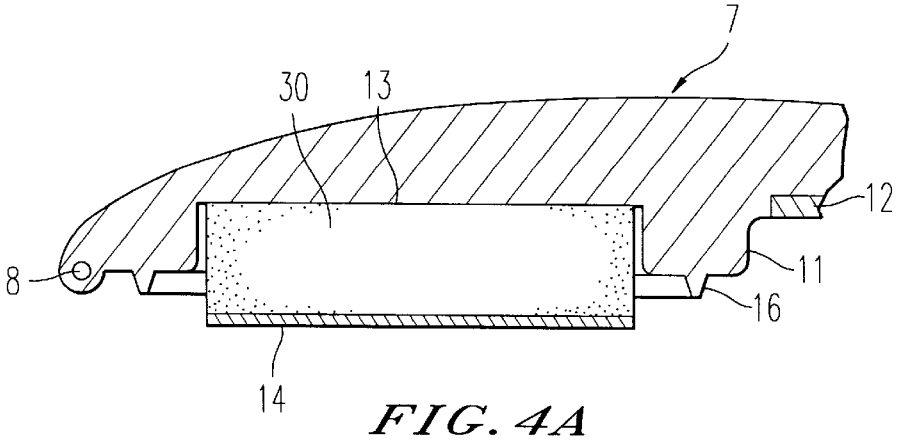
FIGS. 4A–4B illustrate other variants of the packaging device in accordance with the invention.

In the embodiment of FIG. 4A, the spring 15 of FIGS. 1A–1C is replaced by a foam block 30, one side of which is bonded to the second recess 13 of the lid 7. The other side of the foam block 30 is bonded to a corresponding side of the sealing film or protective element 14. The foam block 30 may be formed of closed, open or half-open cells. This configuration allows the protective element 14 to assume the shape of the free surface 18 of the product 4 in a better way during the course of use. Indeed, in the course of use, the free surface 18 of the product 4 generally forms a slight hollow in its central portion, because of the way the product 4 is taken-up.

Figure 4B:
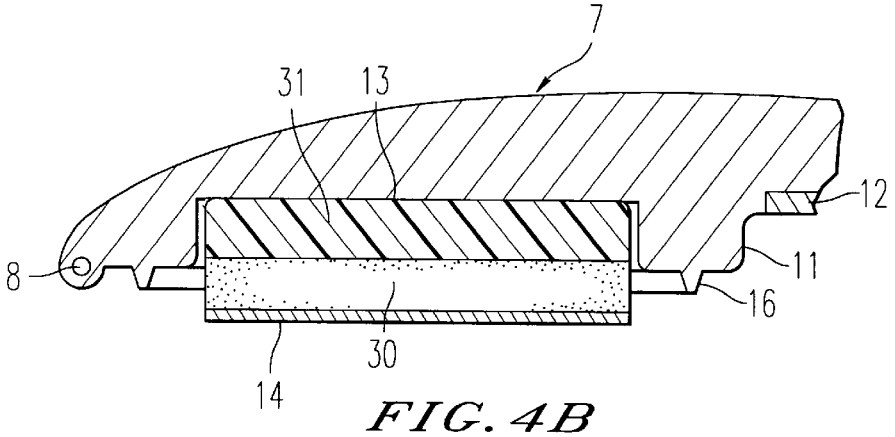

The embodiment of FIG. 4B differs from that of FIG. 4A in that a solvent carrying element 31, saturated with a solvent forming part of the composition of the product 4, is inserted between the lid 7 and the foam block 30. By way of example, the solvent carrying element 31 is formed of a layer of felt, an elastomer or a gel. A passage is arranged between the edge of the solvent carrying element 31 and the internal edge of the second recess 13 of the lid 7, so as to allow the solvent to be released in the space comprised between the body or bottom part 2 and the lid 7, and delimited by the peripheral sealing means formed by the lip 16 and groove 17. Thus, in the closed position of the lid 7, the product 4 is kept in an atmosphere charged with solvent, which improves still further the preservation and quality of the product 4 during its life span.

Figure 5A:
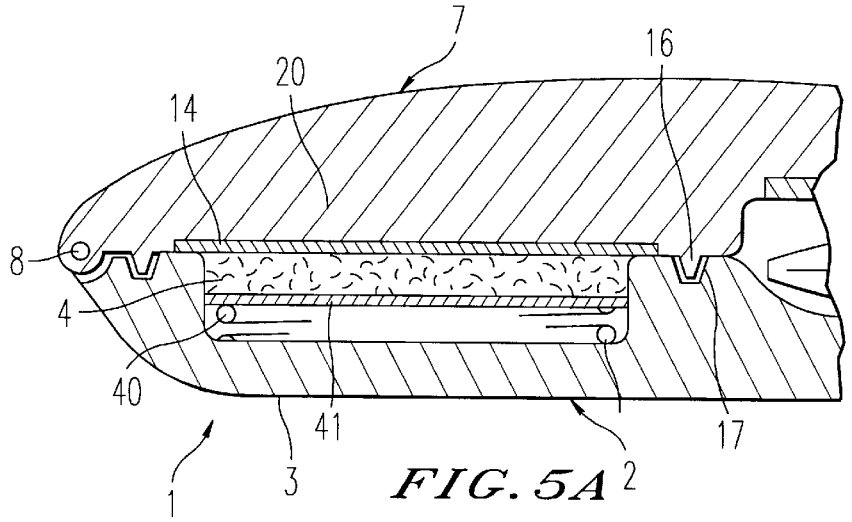
FIGS. 5A–5B illustrate yet another embodiment of the packaging device in accordance with the invention.
Figure 5B:
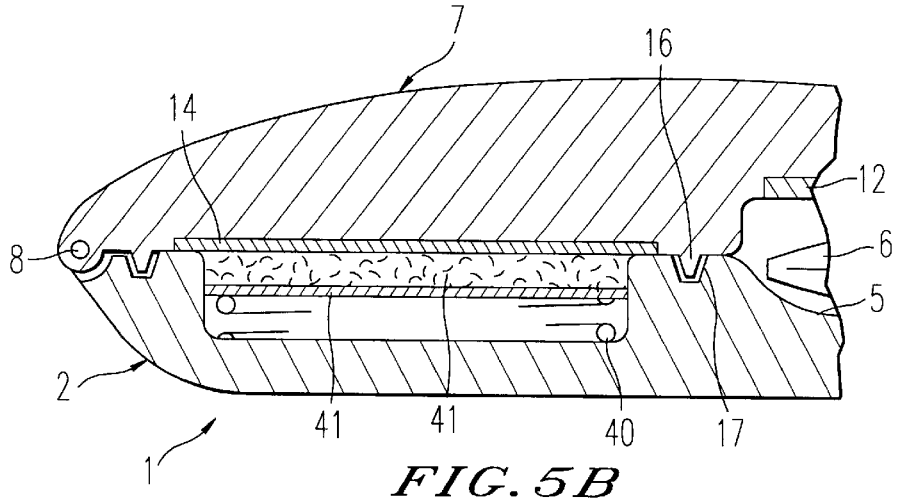

In the embodiment of FIGS. 5A and 5B, the product 4 is disposed at the bottom of the compartment or first recess 3 of the body or bottom part 2 by means of a resiliently deformable element, such as a spring 40 whose resilience and length are chosen so as to keep the free surface 18 of the product 4 in elastic bearing contact with the lid 7, or with a protective element or sealing film 14 carried by the lid 7; this remains the situation irrespective of the level of fill of the compartment or first recess 3 of the bottom part 2 (substantially full with the spring 40 compressed, as shown in FIG. 5A, or half empty with the spring 40 partly compressed, as shown in FIG. 5B). The protective element or sealing film 14 may be bonded to the internal side of the lid 7. Preferably, the product 4 is mounted on the spring 40 by means of a plate or a cup 41. In the same way as in the case of the preceding embodiment, the spring 40 may be replaced by a foam block 30 with closed, open or half open cells.

According to another alternative, not shown, it is possible to envisage mounting, on the one hand, the protective element 14 on the lid 7 by means of a first resiliently deformable element (a spring, foam and etc.) and mounting, on the other hand, the product 4 in the bottom of the compartment or first recess 3 of the bottom part 2 by means of a second resiliently deformable element (a spring, foam and etc.). Such a configuration improves still further the bearing contact of the free surface 18 of the product 4 on the protective element or sealing film 14, and limits the escape of solvent between two successive uses of the product 4.

Thus, with the device in accordance with the invention, there is obtained a resilient positioning system that is independent of the seal of the lid 7, which permits intimate contact between the free surface 18 of the product 4 and the protective element 14, and which substantially slows down the extent of evaporation of the solvent or solvents contained in the product 4. As the product is used up, the protective element 14 remains in virtually leakproof contact with the free surface 18 of the product 4 by assuming the shape of the product 4.

Figure 6:
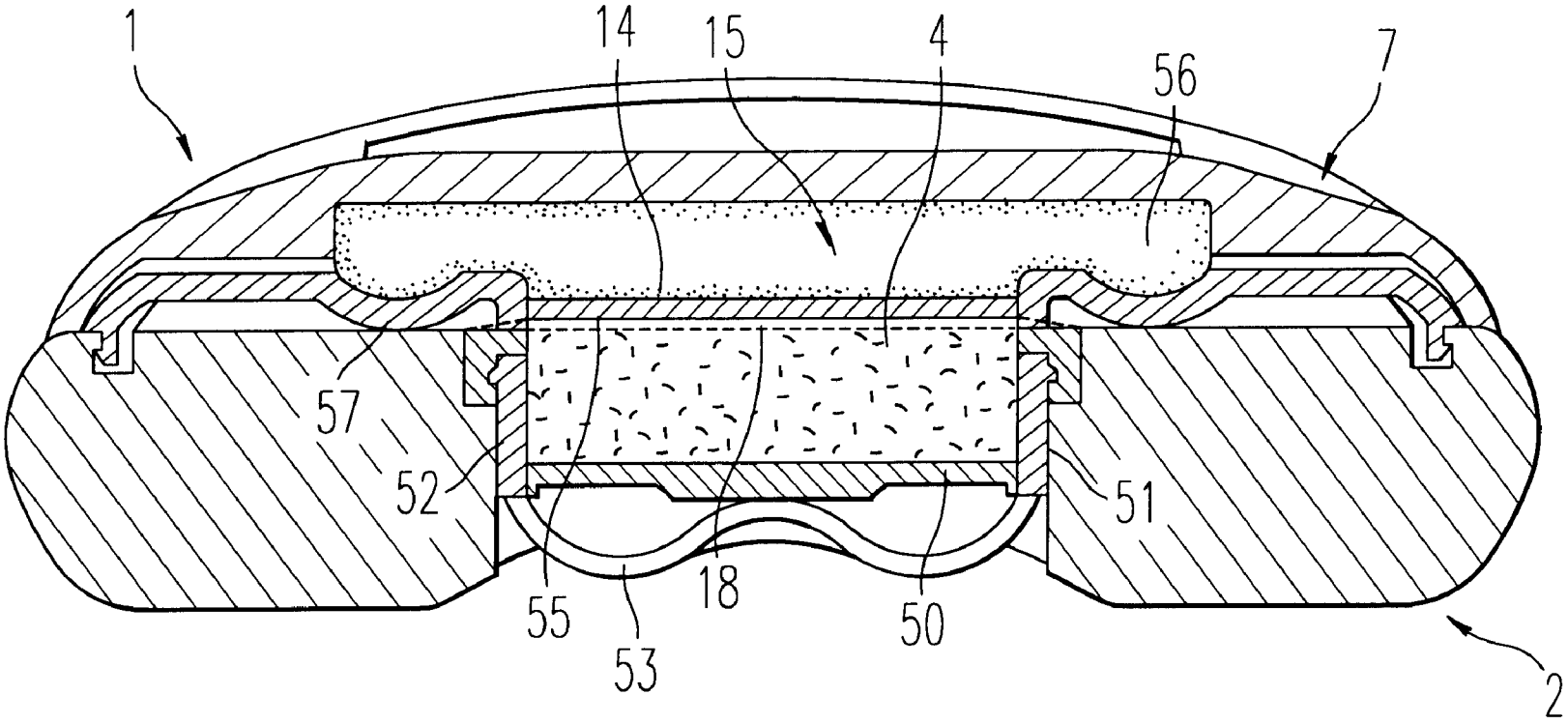
FIG. 6 illustrates yet another embodiment of the packaging device in accordance with the invention.

In the embodiment of FIG. 6, the product 4 is disposed in a removable container 51, the bottom wall of which forms a piston 50, so as to form a varying-volume chamber. The body of the device having a cavity for accepting the removable container 51. The container 51 has a rigid skirt 52, whose opening defined by its lower edge is closed by a flexible membrane 53, comprised of elastomeric thermoplastic material. The flexible membrane 53 has a configuration and an elasticity which are such that the piston 50 is maintained in contact with the product 4 contained in the container 51, the free surface 18 of the product 4 being in close contact with a screen, axially fixed, which will be discussed hereafter in greater detail. The piston 50 movably mounted in the removable container 51 in the bottom of the cavity.

The surface 14, which is solvent-tight, is kept in contact with the free surface 18 of the product 4, through a fixed screen 55, disposed on the upper edge of the removable container 51. In this embodiment, the foam pad 15, one surface 14 of which is solvent tight, has a peripheral flange 56 that, in a closed position of the cover or lid 7, fits into an annular groove 57 provided in an annular element disposed on the upper part of the body 2 of the conditioning device 1. The foam pad 15 is glued to the inner face of the cover 7. Other means can be used to improve the tightness all around the removable container 51. For example, an elastomeric sealing member could be over-injected on the free edge of the container.

As for the other embodiments, as the product 4 is used, the free surface 18 of the product 4 is kept in contact with the screen 55, the upper surface of which is, in a closed position of the cover or lid 7, in close contact with the surface 14 of the pad 15, preventing the formation of any air volume over the surface of the product 4. In a closed position of the cover or lid 7, the piston 50 keeps the product 4 only in contact with the tamis or screen 55, without exerting any pressure capable of causing the distribution of the product 4 through the orifices of the screen 55. For using the device of the invention, the deformable membrane 53 is pressed, so as to allow the distribution of the product through the holes of the screen 55. The product can be taken-up on the surface of the screen 55, either by using the fingers, or by using a conventional applicator, that may be contained in another recess provided for in the container or conditioning device 1. Such an embodiment is particularly adapted for products having a high content of water.

EXAMPLE

As an example of the invention, a compact is made in which the maximum thickness of the product in the cavity or compartment is 5 mm. The product being a cheek make-up containing up to 20% water. The resiliently deformable element is a foam block or pad with open, or half-open cells, and whose thickness is of the order of 8 mm. One side of the foam block is bonded to the internal side of the lid. A polyethylene film, whose thickness is of the order of 0.5 mm, is bonded to the other side of this foam block.

Moreover, tests have been made with compacts with a circular cross-section and compacts with a square cross-section. A polypropylene film of 200 $\mu$m is mounted on the product contained in the form of a cake inside these compacts. The solvent contained in the product is water. The compacts were placed into a drying oven at 45° for 24 hours. Compacts without a polypropylene film were also placed into the drying oven. In the case of the compacts with a circular shape, the loss of weight is 55% for the compacts without a polypropylene film, and only 31% for the compacts in accordance with the invention. In the case of compacts with a square cross-section, the loss of weight is 31.3% for the compacts without the polypropylene film and only 12.3% for the compacts in accordance with the invention. Thus, the improvement is substantial, irrespective of the shape of the compact.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by Letters Patent of the United States is:

1. A packaging device comprising:

a solvent bearing product;

a body having a cavity so as to receive said solvent bearing product having a free surface for taking-up the product;

a lid detachably mounted to said body and covering said cavity when in a closed position;

a protective element which is impermeable to at least one solvent of the product, said protective element being mounted to said lid such that said protective element substantially covers said free surface of the product when said lid is in the closed position, said protective element being flexible so as to substantially conform to a shape of said free surface of the product irrespective of a level of fill of the product in said cavity; and at least one resilient element mounted so as to elastically press the protective element against said free surface of the product when said lid is in the closed position.

2. A packaging device comprising:

a solvent bearing product;

a body having a cavity so as to receive said solvent bearing product having a free surface for taking-up the product;

a lid detachably mounted to said body and covering said cavity when in a closed position;

a protective element which is impermeable to at least one solvent of the product, said protective element being mounted to said lid such that said protective element substantially covers said free surface of the product when said lid is in the closed position, said protective element being selected from the group consisting of a film of polyethylene, of a film of polypropylene, and a film of a complex of polyethylene/terephthalate/aluminum/polyethylene; and at least one resilient element mounted so as to elastically press the protective element against said free surface of the product when said lid is in the closed position.

3. A packaging device according to claim 2, wherein said at least one resilient element is a spring mechanism, and wherein said protective element is formed by a planar element attached to said spring mechanism, said protective element mounted on said lid by way of said spring mechanism.

4. A packaging device according to claim 3, wherein said spring mechanism is a helical spring.

5. A packaging device according to claim 2 further comprising a hinge pin connected to the body, wherein said lid is mounted in an articulated manner on the body around the hinge pin, and further comprising closing means disposed on a side of both said lid and said body remote from said hinge so as to lock said lid in the closed position on the body.

6. A packaging device according to claim 5 further comprising means for sealing a periphery of said cavity.

7. A packaging device according to claim 6, wherein said means for sealing said periphery of said cavity comprises a lip and a groove, said lip formed on an internal side of said lid, said groove formed in the body all around said cavity, said lip cooperates with said groove.

8. A packaging device according to claim 6, wherein said at least one resilient element, said protective element, and said means for sealing said periphery of said cavity are formed by a single piece.

9. A packaging device according to claim 2, wherein the product is selected from the group consisting of a blusher, a make-up foundation, and a cheek make-up.

10. A packaging device comprising:

a body having a cavity so as to receive a solvent bearing product having a free surface for taking-up the product;

a lid detachably mounted to said body and covering said cavity when in a closed position;

a protective element which is impermeable to at least one solvent of the product, said protective element being mounted to said lid such that said protective element substantially covers said free surface of the product when said lid is in the closed position; and at least one resilient element mounted so as to elastically press the protective element against said free surface of the product when said lid is in the closed position, wherein the product is received in said cavity of said body, and wherein said at least one resilient element is a resilient foam block joined to said lid, wherein said protective element is mounted on said resilient foam block.

11. A packaging device comprising:

a body having a cavity so as to receive a solvent bearing product having a free surface for taking-up the product;

a lid detachably mounted to said body and covering said cavity when in a closed position;

a protective element which is impermeable to at least one solvent of the product, said protective element being mounted to said lid such that said protective element substantially covers said free surface of the product when said lid is in the closed position;

at least one resilient element mounted so as to elastically press the protective element against said free surface of the product when said lid is in the closed position; and a solvent carrying element positioned in said lid, said solvent carrying element impregnated by at least one solvent forming part of a composition of the packaged product so as to keep the product in an atmosphere charged with said solvent, and wherein the product is received in said cavity of said body.

12. A packaging device according to claim 11, wherein said solvent carrying element is selected from the group consisting of an elastomer, a felt and a gel.

13. A packaging device comprising:

a solvent bearing product;

a body having a cavity so as to receive said solvent bearing product having a free surface for taking-up the product;

a lid detachably mounted to said body and covering said cavity when in a closed position;

a protective element which is impermeable to at least one solvent of the product, said protective element being mounted to said lid such that said protective element substantially covers said free surface of the product when said lid is in the closed position; and at least one resilient element mounted so as to elastically press the protective element against said free surface of the product when said lid is in the closed position;

wherein said at least one resilient element is mounted at a bottom of said cavity, and wherein the product rests on said at least one resilient element, said free surface of the product being in elastic bearing contact against said protective element in the closed position of said lid on the body.

14. A packaging device comprising:

a body having a cavity so as to receive a solvent bearing product having a free surface for taking-up the product, said cavity extending through said body;

a lid detachably mounted to said body and covering said cavity when in a closed position;

a protective element which is impermeable to at least one solvent of the product, said protective element being mounted to said lid such that said protective element substantially covers said free surface of the product when said lid is in the closed position;

a piston movably mounted in said cavity and forming a bottom of said cavity opposite said free surface, wherein said bottom of said cavity is manually accessible so that manual pressure can be applied to the product in said cavity for pressing the product in said cavity toward said protective element; and at least one resilient element mounted so as to elastically press the protective element against said free surface of the product when said lid is in the closed position.

15. A packaging device according to claim 14 further comprising a screen mounted to said body between said free surface of the product and said protective element such that the product can pass through orifices of said screen.

16. A packaging device according to claim 15, wherein said screen is selected from the group consisting of a woven material, a non-woven material, a grill, a foam, a film, a perforated surface, and a combination of these elements.

17. A packaging device comprising:

a solvent bearing product;

a body having a cavity so as to receive said solvent bearing product having a free surface for taking-up the product;

a lid detachably mounted to said body and covering said cavity when in a closed position; and a resilient protective element being impermeable to at least one solvent of the product, said resilient protective element provides an elastic support for the product when said lid covers the body in the closed position, and wherein said resilient protective element is mounted so that in the closed position of said lid on the body said free surface of the product bears elastically against said resilient protective element such that said resilient protective element substantially covers said free surface of the product, and wherein said resilient protective element is made of a closed cell foam having a thickness and a resilience so that said closed cell foam bears on said free surface of the product irrespective of a level of fill of the product in said cavity.

18. A packaging device according to claim 17, wherein said resilient protective element is made of a closed cell foam selected from the group consisting of a foam of polyethylene, a foam of synthetic butadiene rubber, and a foam of polyvinyl chloride.

* * * * *